US009395158B2

(12) United States Patent
Collin et al.

(10) Patent No.: US 9,395,158 B2
(45) Date of Patent: Jul. 19, 2016

(54) MOUNTING DEVICE FOR WEAPON

(71) Applicant: OptiFlow, Inc., Ann Arbor, MI (US)

(72) Inventors: Fred Collin, Brighton, MI (US); Stephen Michael Shubeck, Ann Arbor, MI (US); Michael L. Marino, Ann Arbor, MI (US); Lamoyne (Jack) Durham, Saline, MI (US)

(73) Assignee: OptiFlow, Inc., Ann Arbor, MI (US)

( * ) Notice: Subject to any disclaimer, the term of this patent is extended or adjusted under 35 U.S.C. 154(b) by 16 days.

(21) Appl. No.: 14/483,726

(22) Filed: Sep. 11, 2014

(65) Prior Publication Data

US 2015/0068095 A1 Mar. 12, 2015

Related U.S. Application Data

(60) Provisional application No. 61/876,519, filed on Sep. 11, 2013.

(51) Int. Cl.
*F41C 27/00* (2006.01)
*F41G 11/00* (2006.01)

(52) U.S. Cl.
CPC ..... *F41G 11/003* (2013.01)

(58) Field of Classification Search
CPC ..... F41G 11/003; F41G 11/004
See application file for complete search history.

(56) References Cited

U.S. PATENT DOCUMENTS 3,877,166 A 4/1975 Ward
4,835,895 A 6/1989 Bowen
5,142,806 A 9/1992 Swan
5,155,915 A 10/1992 Repa
5,276,988 A 1/1994 Swan
5,375,361 A 12/1994 Rustick
5,570,529 A 11/1996 Amelino
5,680,725 A 10/1997 Bell
6,435,738 B1 8/2002 Vogt
6,442,883 B1 9/2002 Waterman et al.
6,598,333 B1 7/2003 Randazzo et al.
6,637,144 B2 10/2003 Nelson et al.
6,922,934 B1 * 8/2005 Huan ..... F41G 11/003 42/127

(Continued)

FOREIGN PATENT DOCUMENTS

IT WO 2009057175 A1 * 5/2009 ..... F41G 11/003

OTHER PUBLICATIONS

Printout of Trijicon, Inc. system (believed to have been offered for sale, publicly used, and/or published prior to the filing date of this application.

*Primary Examiner* — Gabriel Klein
(74) *Attorney, Agent, or Firm* — Dinsmore & Shohl LLP; Douglas L. Wathen

(57) ABSTRACT

A mounting device for mounting an accessory to a rail of a weapon including a base portion, a first side portion configured to engage a first side of a rail of the weapon, and a second side portion configured to engage a second side of the rail. The first side portion has an opening defined therein. A movable clamping member is disposed in the opening in the first side portion so as to be movable between a clamping position where it secures the device to the rail and a retracted position. A clamping lever is pivotally interconnected with the first side portion for movement between an open position and a closed position. A link interconnects the clamping lever and the clamping member such that moving the lever from the open position to the closed position moves the clamping member from the retracted position to the clamping position.

10 Claims, 5 Drawing Sheets

(56) References Cited

U.S. PATENT DOCUMENTS

| | | | | |
|---|---|---|---|---|
| 6,931,778 | B1 | 8/2005 | Nelson et al. | |
| 7,107,716 | B1 | 9/2006 | Liao | |
| 7,204,052 | B2 | 4/2007 | Swan | |
| 7,308,772 | B1 | 12/2007 | Millett | |
| 7,370,449 | B1 | 5/2008 | Beckmann | |
| 7,493,721 | B2 | 2/2009 | Swan | |
| 7,562,485 | B2 | 7/2009 | Newhall et al. | |
| 7,614,175 | B2 | 11/2009 | Davis et al. | |
| 7,685,759 | B2 | 3/2010 | Teetzel | |
| 7,712,242 | B2 * | 5/2010 | Matthews | F41G 11/003 248/229.11 |
| 7,739,824 | B1 | 6/2010 | Swan | |
| 7,823,316 | B2 | 11/2010 | Storch et al. | |
| 8,276,307 | B2 | 10/2012 | Deros | |
| 8,322,066 | B2 | 12/2012 | Westra | |
| 8,336,247 | B2 | 12/2012 | Haering | |
| 8,359,780 | B2 | 1/2013 | Peterson et al. | |
| 8,393,105 | B1 | 3/2013 | Thummel | |
| 8,397,421 | B2 | 3/2013 | Ding et al. | |
| 8,407,923 | B2 | 4/2013 | Ash, Jr. et al. | |
| 8,453,369 | B1 | 6/2013 | Kincaid et al. | |
| 8,567,105 | B1 * | 10/2013 | Bobro | F41G 11/003 42/127 |
| 2002/0162267 | A1 | 11/2002 | Nelson et al. | |
| 2006/0117636 | A1 | 6/2006 | Newhall et al. | |
| 2006/0207156 | A1 | 9/2006 | Larue | |
| 2008/0047190 | A1 | 2/2008 | May | |
| 2008/0092421 | A1 | 4/2008 | Beckmann | |
| 2008/0092422 | A1 | 4/2008 | Daniel et al. | |
| 2008/0155876 | A1 | 7/2008 | Matthews et al. | |
| 2008/0178511 | A1 | 7/2008 | Storch et al. | |
| 2008/0216380 | A1 * | 9/2008 | Teetzel | F41G 11/003 42/127 |
| 2009/0038201 | A1 | 2/2009 | Cheng et al. | |
| 2010/0107467 | A1 | 5/2010 | Samson et al. | |
| 2011/0146128 | A1 * | 6/2011 | Haering | F41G 11/003 42/90 |
| 2011/0247255 | A1 * | 10/2011 | Ding | F41G 11/003 42/90 |
| 2011/0271578 | A1 | 11/2011 | Karagias | |
| 2011/0290968 | A1 * | 12/2011 | Maughan | F41G 11/004 248/231.51 |
| 2012/0180363 | A1 | 7/2012 | Frascati et al. | |
| 2012/0210624 | A1 | 8/2012 | Schneider et al. | |
| 2014/0265085 | A1 * | 9/2014 | Albin | B25B 5/127 269/6 |

* cited by examiner

MOUNTING DEVICE FOR WEAPON

CROSS-REFERENCE TO RELATED APPLICATIONS

This utility patent application claims priority from U.S. provisional patent application Ser. No. 61/876,519, filed Sep. 11, 2013, the entire contents of which is incorporated herein in its entirety.

FIELD OF THE INVENTION

The present invention relates generally to devices for mounting accessories to a weapon.

BACKGROUND OF THE INVENTION

A weapon such as a rifle is often used in combination with one or more accessories, such as a sighting scope. It is common for the weapon to have a mounting rail, and accessories are designed to mount to this mounting rail. Such mounting rails may be generally referred to as receiver rails. One type of a receiver rail is a Weaver rail.

A variety of mounting devices have been developed to allow accessories to be securely clamped to a receiver rail on a weapon. However, each of these mounting devices has certain limitations.

SUMMARY OF THE INVENTION

The present invention provides various embodiments of a mounting device for mounting an accessory to a rail of a weapon. A first embodiment of a mounting device includes a base portion, a first side portion configured to engage a first side of a rail of the weapon, and a second side portion configured to engage a second side of the rail. The first side portion has an opening defined therein.

A movable clamping member is disposed in the opening in the first side portion so as to be movable between a clamping position where it secures the device to the rail and a retracted position. A clamping lever is pivotally interconnected with the first side portion for movement between an open position and a closed position. A link interconnects the clamping lever and the clamping member such that moving the lever from the open position to the closed position moves the clamping member from the retracted position to the clamping position.

In some versions, the first side portion includes a fixed part and an adjustment member adjustably connected to the fixed part. The clamping lever is pivotally interconnected with the adjustment member. The adjustment member may have a first end and a second end, with the first end being pivotally connected to the fixed part and the second end being adjustably positioned adjacent to the fixed part. In some alternatives, an adjuster adjustably connects the second end of the adjustment member to the fixed part. A biasing spring may be provided between the adjustment member and the fixed part so as to urge the adjustment member away from the fixed part.

A second embodiment of a mounting device includes a base portion, a first side portion configured to engage a first side of a rail of a weapon, and a second side portion configured to engage a second side of the rail. An adjustment member is adjustably connected to one of the side portions. A clamping member is movable between a clamping position where it secures the device to the rail and a retracted position. A clamping lever is supported on the adjustment member. The clamping member is movable between an open position and a closed position and configured such that moving the lever from the open position to the closed position moves the clamping member from the retracted position to the clamping position.

DETAILED DESCRIPTION OF THE INVENTION

The present invention provides a mounting device that may be quickly attached to a mounting rail of a weapon and subsequently quickly detached. The mounting device may be configured for use with various types of mounting rails, with the illustrated embodiment being designed for a rail typically referred to as a Weaver rail. A Weaver rail has an opposed first and second side and an upper face extending between the opposed sides. Alternatively, the mounting device may be configured for use with other types of rails.

Figure 1:
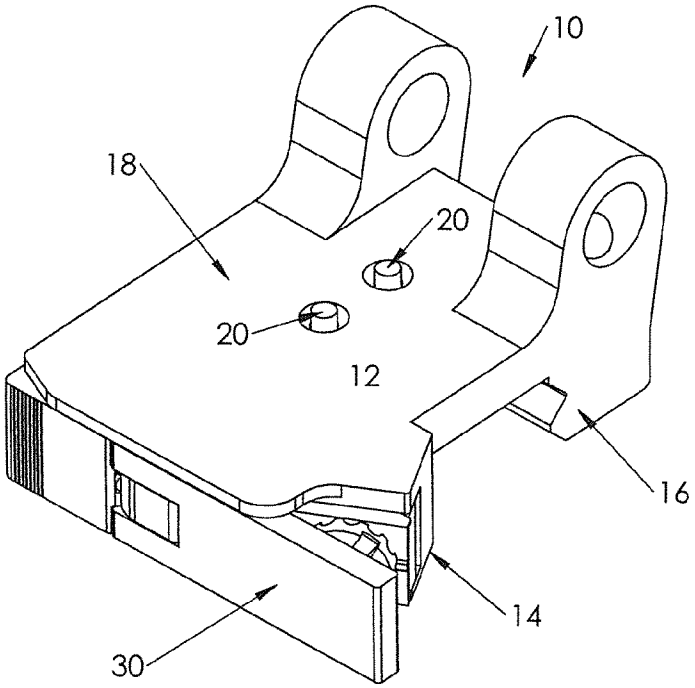
FIG. 1 is a perspective view of an embodiment of a mounting device in accordance with the present invention.
Figure 2:
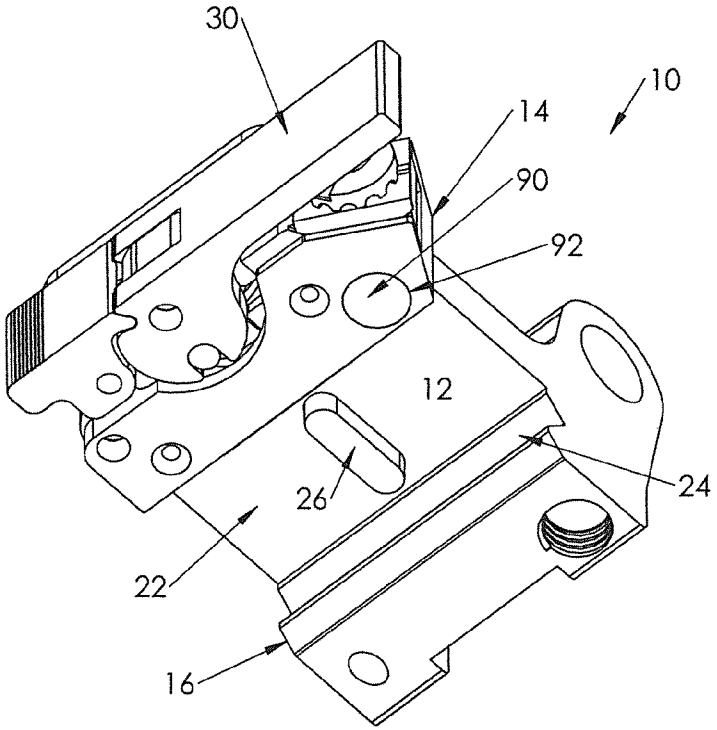
FIG. 2 is another perspective view of the mounting device of FIG. 1, showing the underside of the mounting device.
Figure 9:
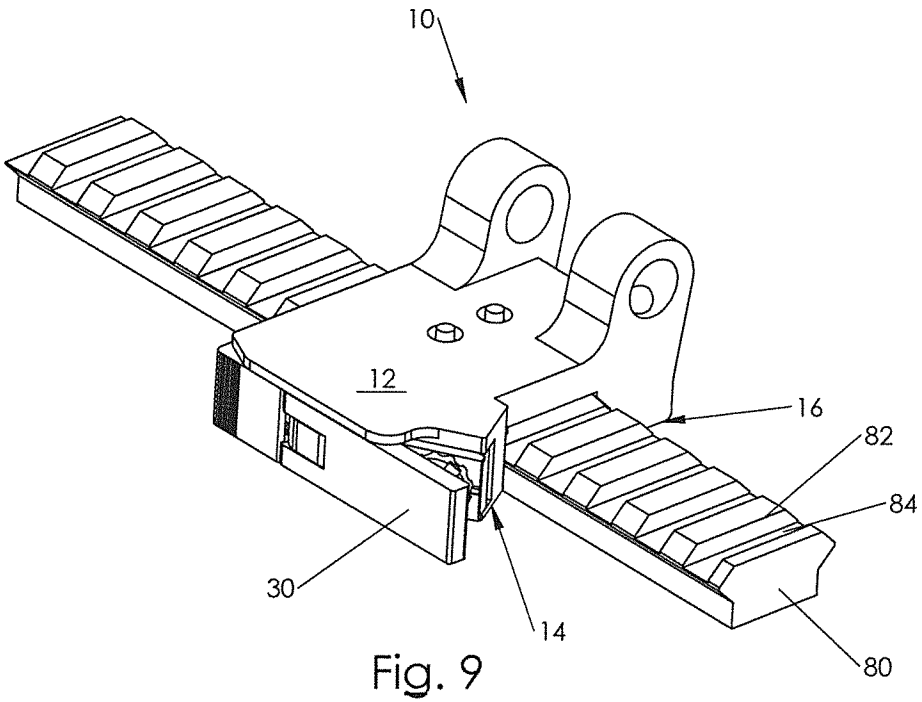
FIG. 9 illustrates a perspective view of the mounting device of FIG. 1 mounted to a rail.

Referring to FIGS. 1 and 2, a mounting device in accordance with an embodiment of the present invention is shown at 10. The mounting device includes a base portion 12, a first side portion 14, and a second side portion 16. The mounting device 10 may be part of a larger component, such as a scope or a flip mount, or may have other components attached thereto. The mounting device 10 is shown generally in a use position in FIG. 1, with the base portion 12 having a generally planar upper surface 18. Other elements may be connected to the mounting device 10 in various ways, such as using connecting elements 20. The base portion 12 has an opposed lower surface 22 which may contact an upper surface of the rail when the mounting device 10 is mounted thereto. The first side portion 14 and second side portion 16 may be said to extend downwardly from the base portion 12 so as to engage the first side and second side of the rail, respectively. In the illustrated embodiment, the first side portion 14 and second side portion 16 are integrally formed with the base portion 12. As best shown in FIG. 2, the second side portion 16 has an inner surface 24 that is shaped so as to engage the second side of the rail. A locating element 26 may extend downwardly from the lower surface 22 of the base portion 12 for engaging slots in the upper surface of the rail 80, such as shown in FIG. 9. The locating element 26 is adapted to rest between the protrusions 82 within the valleys 84 of the rail. The rail 80 is adapted to connect to a gun or other weapon.

The first side portion 14 incorporates a movable clamping member that is movable between a clamping position where it secures the device to the rail and a retracted position. This clamping member is moved between its clamping position and retracted position by a clamping lever 30.

Figure 4:
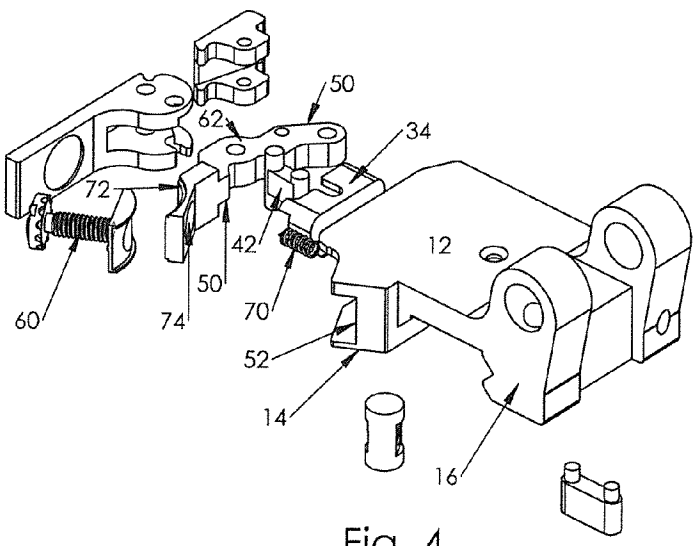
FIG. 4 is an additional exploded perspective view of the mounting device of FIGS. 1-3 illustrated at a different angle than in FIG. 3.
Figure 3:
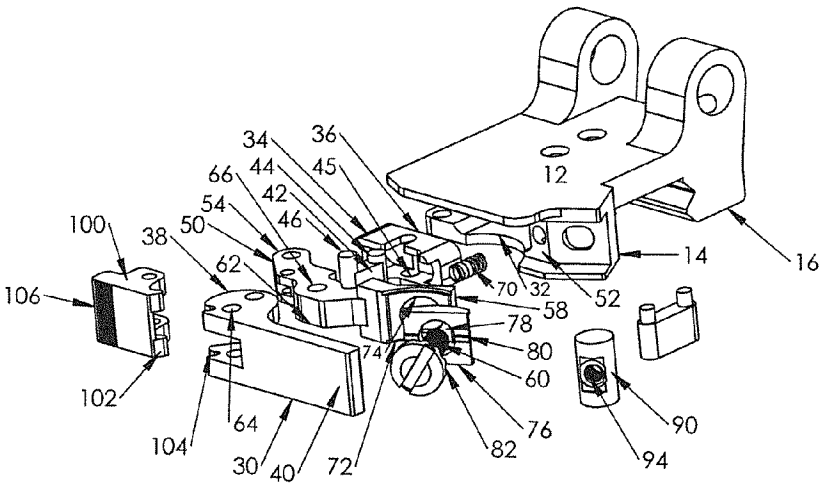
FIG. 3 is an exploded perspective view of the mounting device of FIGS. 1 and 2 showing the component elements.
Figure 5:
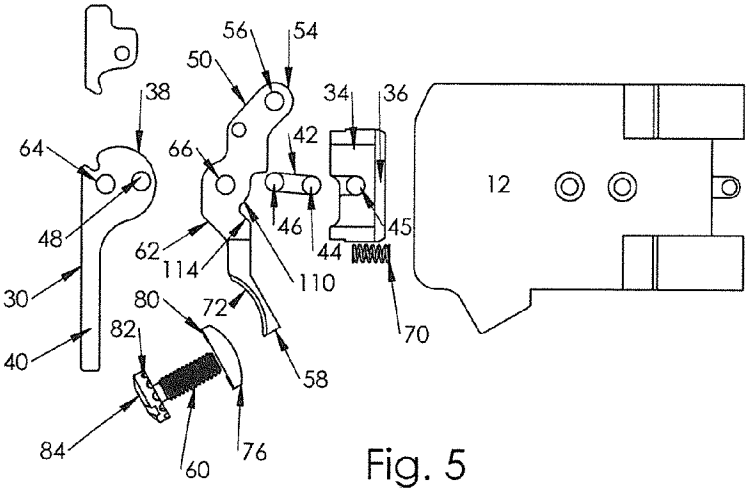
FIG. 5 is an exploded top view of the mounting device of FIGS. 1-4.
Figure 6:
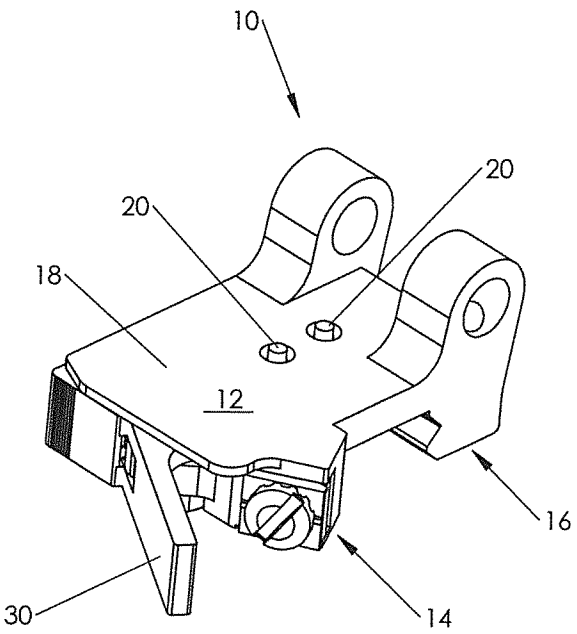
FIG. 6 illustrates a perspective view of the mounting device of FIG. 1 in an open position.
Figure 8:
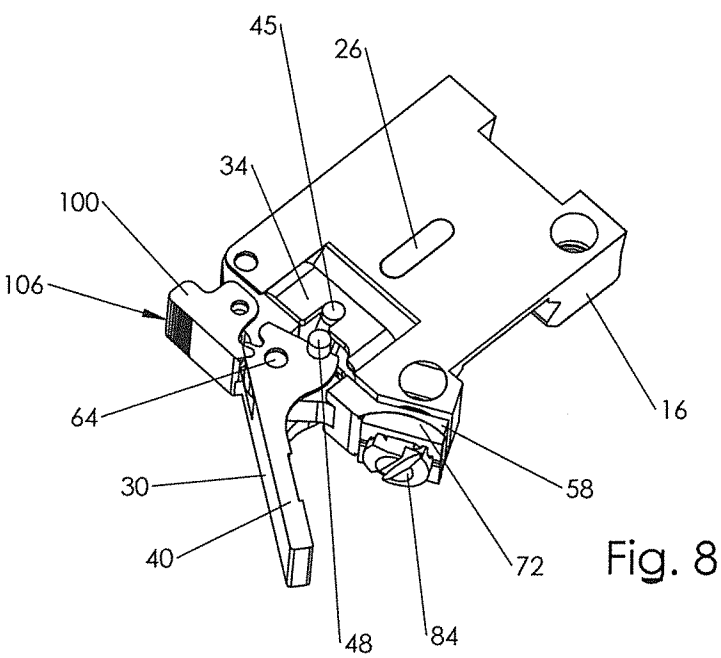
FIG. 8 illustrates a partial cut-away perspective view of the mounting device of FIG. 1 in an open position.
Figure 7:
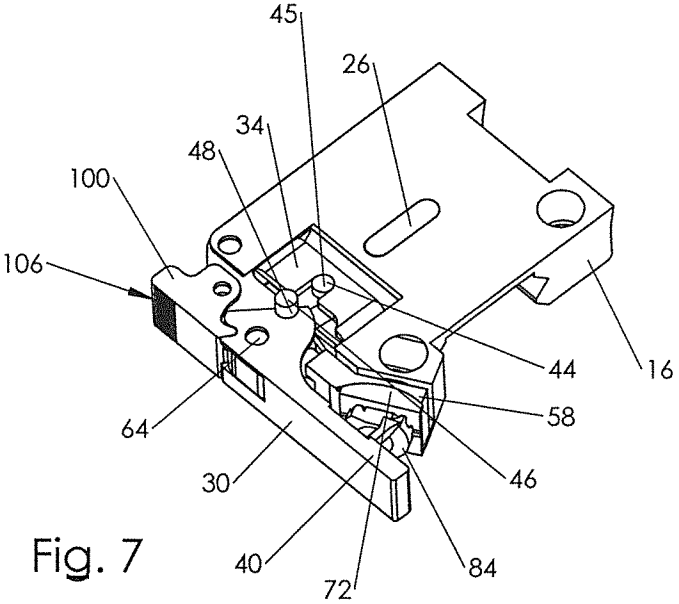
FIG. 7 illustrates a partial cut-away perspective view of the mounting device of FIG. 1 in a closed position.

FIGS. 3-5 provide various exploded views of the mounting device 10. Further aspects of the mounting device will be described with reference to these drawings. As best shown in FIG. 3, the first side portion 14 has an opening 32 defined therein. The previously discussed clamping member is shown at 34 and is slidably received in the opening 32. The clamping member 34 has an inner face 36 that engages the first side of the rail when the clamping member is in a clamping position. The face 36 engages the side of the rail and secures the mounting device 10 to the rail. The clamping lever 30 is operable to move the clamping member 34 between the retracted position and the clamping position. Specifically, when the clamping lever 30 is in the illustrated position, referred to as a closed position, the clamping member is in the clamping position. When the lever 30 is moved to an open position, not shown, the clamping member moves to a retracted position.

The clamping lever 30 may be said to have a pivot portion 38 and a handle 40 that rotates the pivot portion 38. In the illustrated embodiment, the clamping lever is interconnected with the clamping member 34 by a link 42. The link 42 has an inner end 44 that is pivotally coupled to the clamping member 34 by engaging opening 45 in the clamping member 34. The link 42 further has an outer end 46 that is pivotally coupled to the pivot portion 38 of the clamping lever 30. Specifically, the outer end 46 of the link 42 is engaged with a pivot opening 48 in the pivot portion 38 of the lever 30.

As known to those of skill in the art, it is desirable to have some adjustability in a mounting device for mounting an accessory to a weapon. Specifically, it is desirable to be able to adjust the final clamping position or the amount of clamping force of the clamping member onto the rail. In some versions of the present invention, this is accomplished by pivotally mounting the clamping lever 30 to an adjustment member, with the position of the adjustment member being adjustable. Referring to FIGS. 3-5, such an adjustment member is shown at 50. This adjustment member 50 may be considered as part of the first side portion 14 or is a separate component. If considered part of the overall first side portion 14, the remainder of the side portion shown at 52 may be considered to be a fixed part of the first side portion 14.

The adjustment member 50 may be said to have a first end 54 that is pivotally connected to the fixed part 52 of the first side portion 14. Specifically, the first end 54 has a pivot location 56 for connection to the fixed part 52, such as by a pivot pin, not shown. The adjustment member 50 has an opposite second end 58 that is adjustably positioned adjacent to the fixed part 52. In the illustrated embodiment, this adjustable positioning is accomplished using an adjuster 60 in the form of a threaded fastener. As will be clear to those of skill in the art, by adjusting the adjuster 60, the position of the adjustment member 50 may be altered. The pivot portion 38 of the clamping lever 30 is pivotally connected to a mid portion 62 of the adjustment member 50. Specifically, the pivot portion 38 includes a pivot location 64 that engages a corresponding pivot location 66 on the mid portion 62 of the adjustment member 50.

As will be clear to those of skill in the art, because the clamping lever 30 is pivotally mounted to a mid portion 62 of the adjustment member 50, adjusting the adjuster 60 will change the position of the clamping lever 30 relative to the fixed part 52 of the first side portion 14. The link 42 interconnects the clamping lever 30 with the clamping member 34 and therefore adjustment of the adjustment member adjusts the position of the clamping member in the clamping position. A biasing spring 70 may be provided between the fixed part 52 and the adjustment member 50 so as to bias the adjustment member outwardly against the adjuster 60.

In the illustrated embodiment, the second end 58 of the adjustment member 50 has a saddle area 72 with an opening 74 therein. An adapter 76 engages the saddle area 72 and also has an opening 78 therein. The adjuster 60 passes through the openings 78 and 74 with the adapter 76 cooperating with the saddle area 72 to allow the adjuster to smoothly change angle with respect to the adjustment member 50 as the adjustment member pivots with respect to the fixed part 52. The adapter 76 may have one or more ridges 80 defined thereon that engage recesses 82 in the head 84 of the adjuster 60. The ridges and recesses cooperate to define detents for the adjuster 60. This allows an operator to move the adjuster in discrete steps. To further provide for smooth operation of the adjuster 60, a generally cylindrical receiving element 90 is disposed in a bore 92 (see FIG. 2) in the fixed part 52 of the first side portion 14. The receiving element 90 has a threaded opening 94 defined in a side thereof for threadably receiving the threaded portion of the adjuster 60.

In some embodiments of the present invention, it may be desirable to provide a locking mechanism for locking the clamping lever in the closed position. This may be accomplished in a variety of ways. In the illustrated embodiment, a latch 100 is pivotally connected to the adjustment member 50 and has a catch 102 that engages a recess 104 in the pivot portion 38 of the clamping lever 30 when the clamping lever is in the closed position. An outer end 106 of the latch 100 may be depressed so as to release the locking mechanism.

As will be clear to those of skill in the art, the specific configuration of the link 42 and clamping lever 30 may vary. In the illustrated embodiment, the link 42 moves to an "over center" position when in the clamping position. As best shown in FIG. 5, the outer end 46 of the link 42 is moved upward (with respect to the orientation of the figure) relative to the inner end 44. This means that the outer end 46 is above a line drawn from the pivot location 45 in the clamping member 34 and the pivot location 64 in the pivot portion 38 of the clamping lever 30. As the clamping lever 30 is moved to the open position, by moving the handle 40 outwardly, the outer end 46 of the link 42 passes this line and moves out of the over center position. As clear to those of skill in the art, this movement into and out of an over center position may be desirable and helps to move the clamping lever fully into the closed position. Also, as best shown in FIG. 5, the inner surface 110 of the adjustment member 50 is shaped so as to provide clearance for the outer end 46 of the link 42. It also defines a travel limit since the recess located at 110 has walls 112 and 114 which will define the limit of travel of the outer end 46 of the link 42.

As will be clear to those of skill in the art, the herein described embodiments of the present invention may be altered in various ways without departing from the scope or teaching of the present invention. As such, this disclosure should be interpreted broadly. It is noted that the figures included herewith are to scale for some versions and as such may be used to determine angles, ratios, relative sizes, and other characteristics of certain versions. However, these drawings are not limiting for other versions of the present invention.

The invention claimed is:

1. A mounting device for mounting an accessory to a weapon, the mounting device comprising:

a base portion;

a first side portion configured to engage a first side of a rail of a weapon, the first side portion having an opening defined therein, the first side portion further includes a fixed part and an adjustment member adjustably connected to the fixed part, the adjustment member having a first end and a second end, the first end being pivotally connected to the fixed part and the second end being adjustably positioned adjacent to the fixed part;

a second side portion configured to engage a second side of the rail of the weapon, the second side of the rail being opposite the first side of the rail;

a movable clamping member disposed in the opening in the first side portion so as to be movable between a clamping position and a retracted position, the clamping position defined when the clamping member secures the device to the rail;

a clamping lever pivotally interconnected with the first side portion for movement between an open position and a closed position, the clamping lever being pivotally interconnected with the adjustment member;

a link interconnecting the clamping lever and the clamping member such that moving the lever from the open position to the closed position moves the clamping member from the retracted position to the clamping position; and an adjuster adjustably connecting the second end of the adjustment member to the fixed part.

2. A mounting device in accordance with claim 1, further comprising:

a biasing spring disposed between the adjustment member and the fixed part so as to urge the adjustment member away from the fixed part.

3. A mounting device in accordance with claim 1, wherein:

the clamping member is slidably received in the opening in the first side portion.

4. A mounting device in accordance with claim 1, wherein:

the link being pivotally interconnected with the clamping lever and pivotally interconnected with the clamping member.

5. A mounting device in accordance with claim 1, further comprising:

a locking mechanism operable to lock the clamping lever in the closed position, the locking mechanism including a latch having a catch that selectively engages the clamping lever when the clamping lever is in the closed position.

6. A mounting device for mounting an accessory to a weapon, the mounting device comprising:

a base portion;

a first side portion configured to engage a first side of a rail of a weapon, the first side portion further includes a fixed part and an adjustment member adjustably connected to the fixed part;

a second side portion configured to engage a second side of the rail of the weapon, the second side of the rail being opposite the first side of the rail;

the adjustment member being adjustably connected to the first side portion, the adjustment member has a first end and a second end, the first end being pivotally connected to the fixed part and the second end being adjustably positioned adjacent to the fixed part; and a clamping member movable between a clamping position and a retracted position, the clamping defined where the clamping member secures the device to the rail;

a clamping lever supported on the adjustment member, the clamping lever being pivotally interconnected with the adjustment member, the clamping member being movable between an open position and a closed position and configured such that moving the lever from the open position to the closed position moves the clamping member from the retracted position to the clamping position; and an adjuster adjustably connecting the second end of the adjustment member to the fixed part.

7. A mounting device in accordance with claim 6, further comprising:

a biasing spring disposed between the adjustment member and the fixed part so as to urge the adjustment member away from the fixed part.

8. A mounting device in accordance with claim 6, wherein:

the clamping member is slidably received in the opening in a first side portion.

9. A mounting device in accordance with claim 6, wherein:

a link is pivotally interconnected with the clamping lever and pivotally interconnected with the clamping member.

10. A mounting device in accordance with claim 6, further comprising:

a locking mechanism operable to lock the clamping lever in the closed position, the locking mechanism including a latch having a catch that selectively engages the clamping lever when the clamping lever is in the closed position.

* * * * *